US005125664A

United States Patent [19]

Evans

[11] Patent Number: 5,125,664

[45] Date of Patent: Jun. 30, 1992

[54] GOLF PUTTER AND PUTTING TRAINING METHOD

[76] Inventor: Roger C. Evans, 250 Palm Park Cir., No. 206, Longwood, Fla. 32779

[21] Appl. No.: 727,230

[22] Filed: Jul. 5, 1991

Related U.S. Application Data

[63] Continuation-in-part of Ser. No. 388,708, Aug. 2, 1989, and a continuation-in-part of Ser. No. 557,497, Jul. 24, 1990.

[51] Int. Cl.[5] ..... A63B 69/36; A63B 53/04

[52] U.S. Cl. ..... 273/183 D; 273/163 R; 273/167 B; 273/80 C; 273/164; 273/167 A; 273/169; 273/80 A

[58] Field of Search ..... 273/169, 170, 171, 172, 273/167 F, 183 D, 186 A, 186 C, 194 R, 194 A, 194 B, 163 R, 163 A, 164, 77 R

[56] References Cited

U.S. PATENT DOCUMENTS 1,331,499 2/1920 Hartford ..... 273/163 A
3,667,761 6/1972 Palotsee ..... 273/164 X
4,462,595 7/1984 Hodson ..... 273/77 R X
4,819,943 4/1989 Szczepanski ..... 273/164 X

*Primary Examiner*—George J. Marlo
*Attorney, Agent, or Firm*—Allen, Dyer, Doppelt, Franjola & Milbrath

[57] ABSTRACT

A golf putter useful for training a golfer in improving putting skills includes a club head which is dimensioned lateral direction to the club shaft and balanced with the shaft so as to permit the head to lie flat upon a playing surface with the club shaft standing upright while unattended. Alignment marks or a detachable alignment guide permit the golfer to observe the alignment of the club face or a hole with respect to a golf ball, while the club is unattended. The detachable alignment guide may be an elongated tubular element having a longitudinal slit at one end thereof for fitting onto an upstanding riser on the top surface of the club head. The guide extends from the riser, vertically above the club head striking face, and over the golf striking face, and over the golf ball being putted.

13 Claims, 8 Drawing Sheets

GOLF PUTTER AND PUTTING TRAINING METHOD

This application is a Continuation-in-part of Design Application Ser. No. 388,708, filed on Aug. 2, 1989; and a Continuation-in-part of Design Application Ser. No. 557,497 filed on Jul. 24, 1990.

DESCRIPTION OF THE INVENTION

1. Field of the Invention

The present invention relates generally to golf clubs, and in particular relates to a golfing putter and method for training and improving putting skills.

2. Description of the Prior Art

It is well known that putting makes up a large percentage of a golfer's total score, which is highlighted by the fact that every golf course is designed with par values for each hole that allow for two putts per hole to meet par. Thus, a typical perfect round, played exactly as a course might be designed to be played, would include 36 approach shots to the 18 greens, and then 36 putts. Thus, fifty percent of a golfer's total score is attributable to shots made with a putter.

A variety of putters have been designed in an attempt to help golfers become more efficient in putting. Generally, however, most professional golf teachers place problems with putting in two categories, direction and distance. The problem associated with direction means the path a golf ball must follow to fall into the hole, and distance refers to the amount of energy that must be imparted to the ball to drive it to the hole.

A variety of putter designs have been proposed in the past for aiding in the training of a golfer, and improving putting skills. By way of example, U.S. Pat. Nos. 653,023 to Holden and 697,542 to Robertson disclose an appendage which extends rearwardly from the club head. U.S. Pat. No. 837,030 to Blanchard discloses a sighting element across the top of the club head; see also, U.S. Pat. No. 308,238 to Francu. U.S. Pat. No. 1,046,343 to Smith discloses a putter with a rearwardly extending element as well, as does U.S. Pat. No. 1,291,967 to McDougal. U.S. Pat. No. 1,327,171 to Ruggles discloses a golf club having a flat bottom surface.

Other prior art of interest includes the following U.S. Pat. Nos. 792,631 to Taylor; 823,082 to Robertson; 1,331,499 to Hartford; 1,486,823 to Allen; 1,352,020 to Olson; 786,268 to Corey et al; 807,224 to Vaile; 1,116,417 to Hackbarth; 687,539 to Palmer; 656,099 to Dunn; 723,534 to Knight; 802,264 to Brown; and 1,250,296 to Fitzjohn et al.

SUMMARY OF THE INVENTION

The present invention is directed to a versatile golf putter useful as both a practice tool to improve a golfer's putting skills, and also as a putter for use during normal playing conditions. These objects are accomplished through several design features, including construction and balancing of the putter to permit the club to stand by itself behind a golf ball, enabling a golfer to leave the putter unattended and view the intended direction of ball travel from a better vantage point, either from behind the ball looking toward the hole or from behind the hole looking toward the ball and the free standing putter. Second, the putter is provided with alignment marks which enable the golfer to precisely align the putter face perpendicular to the intended direction of ball travel. Two outside alignment marks allow the golfer to visualize the oversized drop zone of the hole. Third, a detachable practice alignment guide is provided to enhance the golfer's ability to align the putter properly before striking the ball, so as to reveal the desired stroke path the putter is to follow. Fourth, the construction of the putter is such as to impart desirable top spin without manipulating the position of the club face with respect to the ball. Fifth, the putter of the present invention permits a variety of different locations where the nozzle can be attached during manufacturing, in order to provide putters with variations in the completed state. Sixth, the putter shaft is coupled to the club head in such a way as to permit the facile adjustment of the angle of the club shaft for the particular needs of an individual golfer.

These benefits are provided in a putter including a club shaft having a proximal gripping end adapted to be held by the golfer, and a distal end, with a club head fixed to the shaft at the distal end. The club head has a sufficient dimension lateral to the direction of the club shaft, and with the head on the shaft being balanced so as to permit the head to lie flat upon a playing surface so that a player may leave the club standing upright while unattended. The club has a forward face for striking a golf ball, and includes means for permitting the golfer to observe the alignment of the club face or the hole with respect to a golf ball, while the club is unattended.

In the preferred construction, the putter includes a body plate extending generally lateral to the direction of the club shaft and a face plate attached with and generally normal to the body plate, with the club face across the outside surface of the face plate. Preferably, the alignment means comprise first and second pairs of spaced alignment marks extending across the upper surface of the body plate and generally normal to the club face. The dimension between the first pair of alignment marks is equal to the diameter of a golf ball, and the dimension between the second pair of alignment marks is equal to the dimension of the expanded ball drop zone (i.e., the diameter of the hole, together with a dimension slightly less than two radii of a golf ball, as is described in greater detail below with reference to FIG. 8).

The putter in accordance with the present invention also includes an alignment guide removably attachable to the club head and having a dimension sufficient to extend from the head, across the plane of the club face and over an adjacent golf ball.

Suitably, the face plate of the club head extends substantially below the plane of the body plate, so that the weight of the club head is such as to impart top spin to a golf ball when struck by the club face, which is also facilitated by forwardly disposing the club shaft relative to the plane of the club face.

In its preferred form, the putter of the present invention utilizes weighted, spaced struts at the outer extremities of the body plate, which provides unique balance characteristics.

In an alternate form of the putter, a shortened bottom plate is provided extending generally parallel with and spaced from the body plate, in order to impart reduced friction characteristics to the club head.

These and other objects of the present invention as well as additional advantages will be more clearly understood with reference to the accompanying drawing, to which identical reference numerals refer to the same element.

THE DRAWING

DETAILED DESCRIPTION

Figure 1:
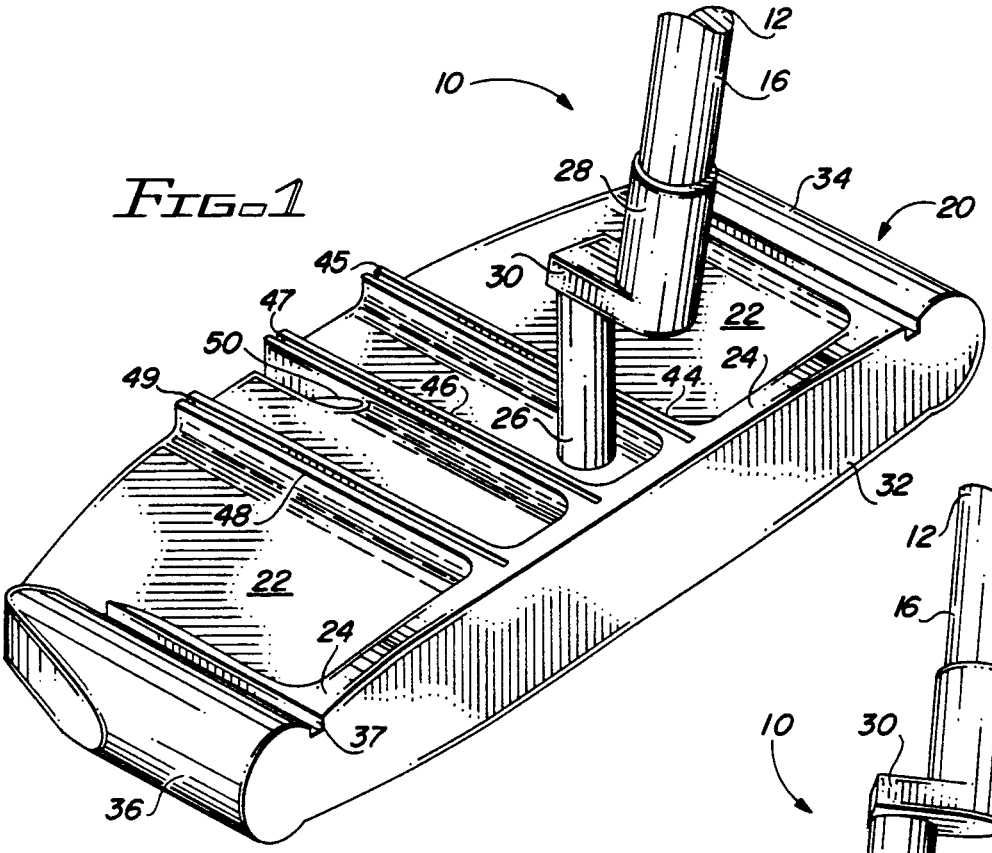
FIG. 1 is a perspective view illustrating the golf putter of the present invention.

A preferred form of a putter in accordance with the present invention is shown and described with reference to FIGS. 1–9, where the putter is referred to generally by the reference numeral 10.

The putter 10 includes a club shaft 12 having a proximal gripping end 14 adapted to be held by the golfer, and a distal end 16. The putter 10 further includes a club head, referred to generally by the reference numeral 20, which is attached to the distal end 16 of the shaft 12. As is described in greater detail below, the head 20 has a sufficient dimension lateral to the direction of the shaft 12 and is balanced with the shaft so as to permit the head 20 to lie flat upon a playing surface such that a player may leave the shaft 12 standing upright while unattended.

Figure 2:
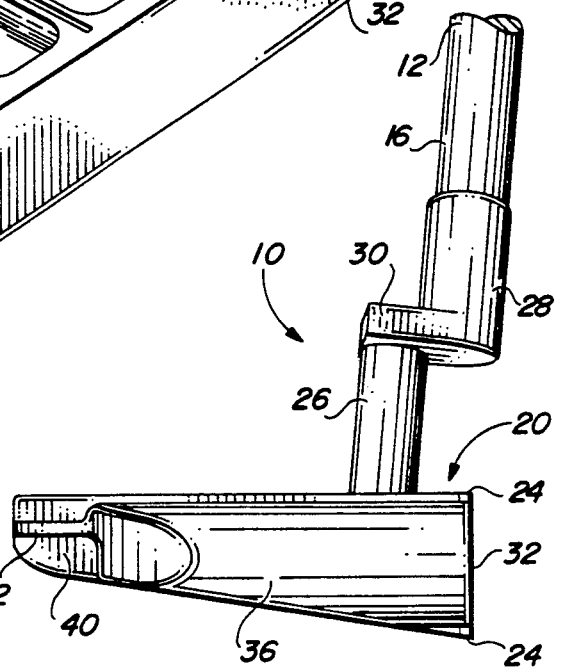
FIGS. 2, 3, 4, 5 and 6 are side, top, bottom, rear and front views of the golf putter shown in FIG. 1.
Figure 3:
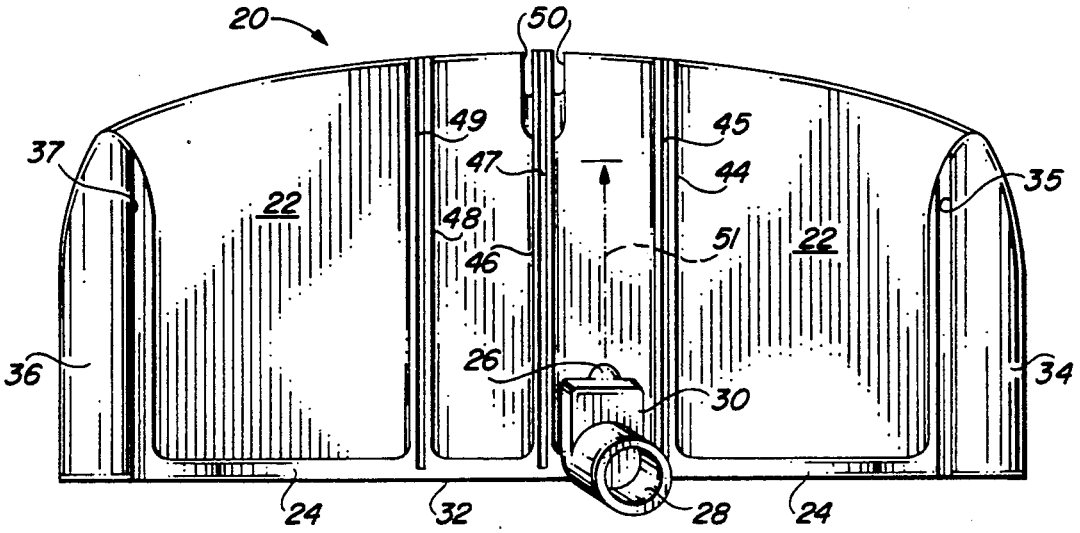

To this end, the head 20 includes a body plate 22 extending generally laterally to the direction of the club shaft 12, and attached thereto via an upright 26 having an oval cross section, the purpose for which is described in greater detail below. The upright 26 is in turn connected to a fitting 28 for receiving the distal end 16 of the shaft 12, the fitting 28 being joined to the upright 26 via an offset 30. As is shown in FIGS. 2 and 3, the offset extends forwardly, so that the fitting 28 extends generally over the club face 32. (FIGS. 1–7 illustrate a right-handed putter; the upright 28 for a left-handed putter would be positioned on the opposite side).

The club head 20 further includes a face plate 24 attached with and extending generally normal to the body plate 22, with the club face 32 across the forward, outside surface of the face plate 24.

Figure 8:
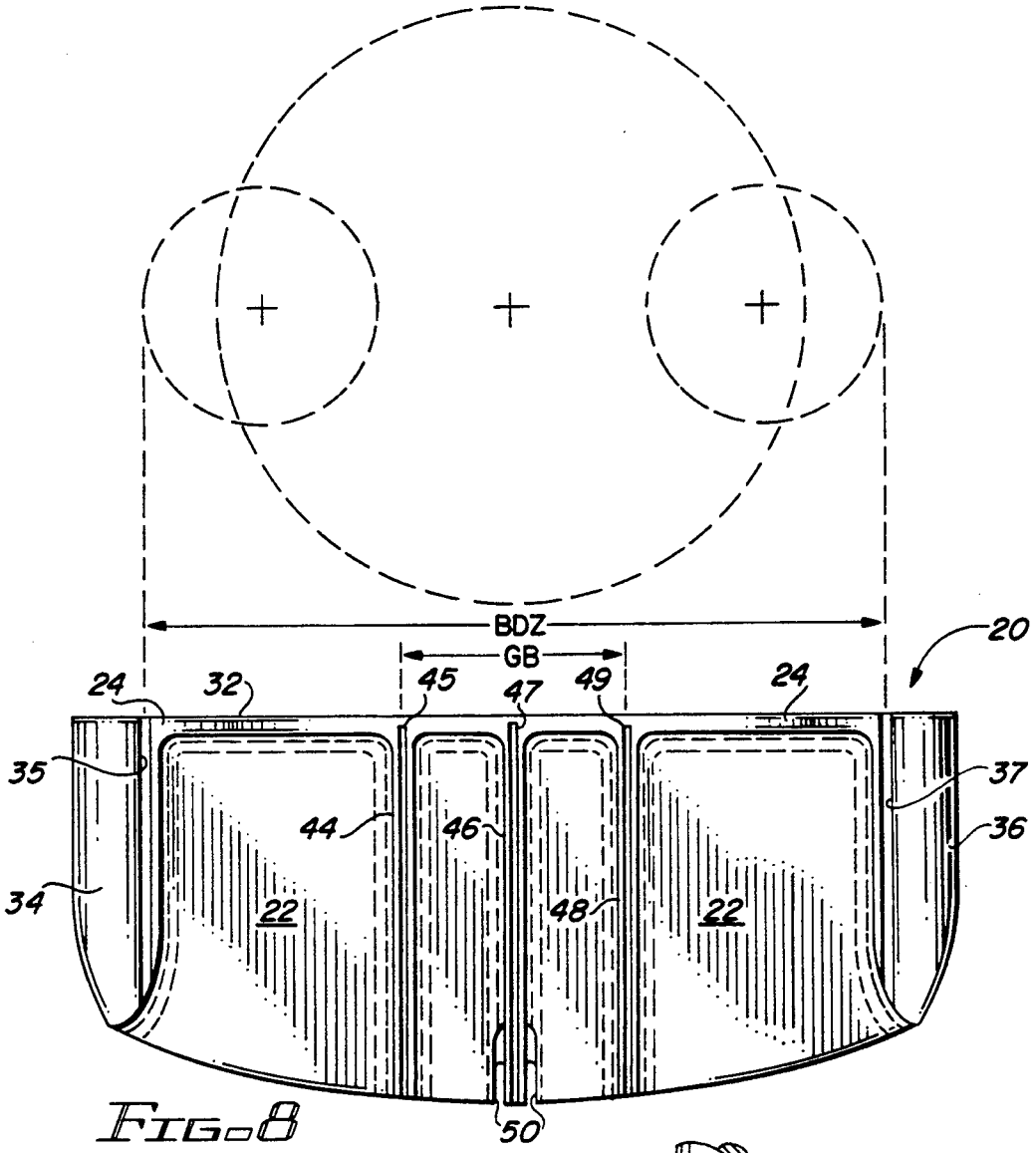
FIG. 8 is a top plan view similar to FIG. 3, illustrating the dimensional relationships between the alignment marks on the top of the club head relative to the diameter of a golf ball and the dimension of the ball drop zone.

The club head 20 further includes a pair of weighted struts 34, 36 each positioned at an outside extremity of the body plate 22, and extending generally laterally from the club face 32. Each strut 34, 36 also includes a respective alignment mark 35, 37 which extends laterally from the club face and generally parallel to the direction of ball travel. As is shown in FIG. 8, the dimension between the alignment marks 35, 37 is a dimension referred to as the "ball drop zone", and which dimension is equal to the diameter of the hole, together with a dimension somewhat less than two radii of golf balls, so that any ball rolling along the side of a cup within that dimension will indeed fall into the cup, as desired.

Figure 4:
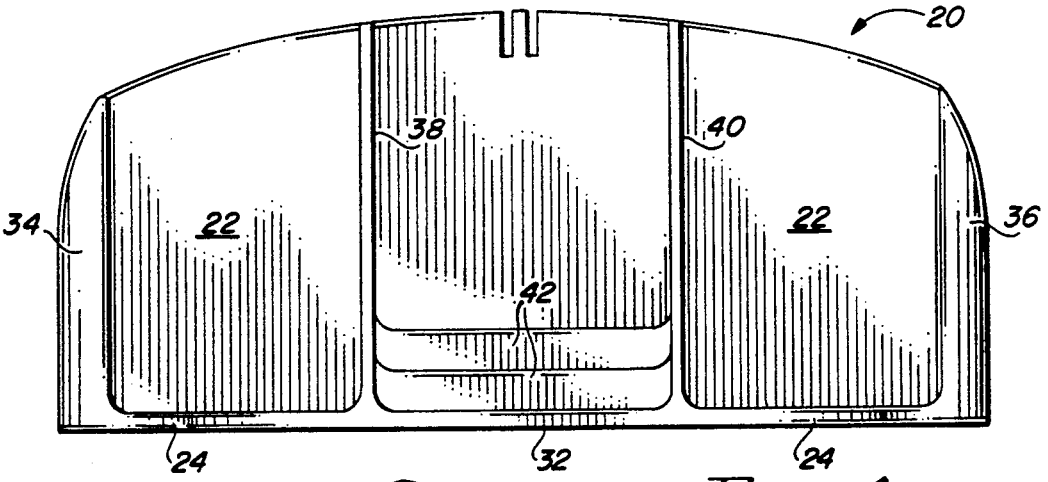
Figure 7:
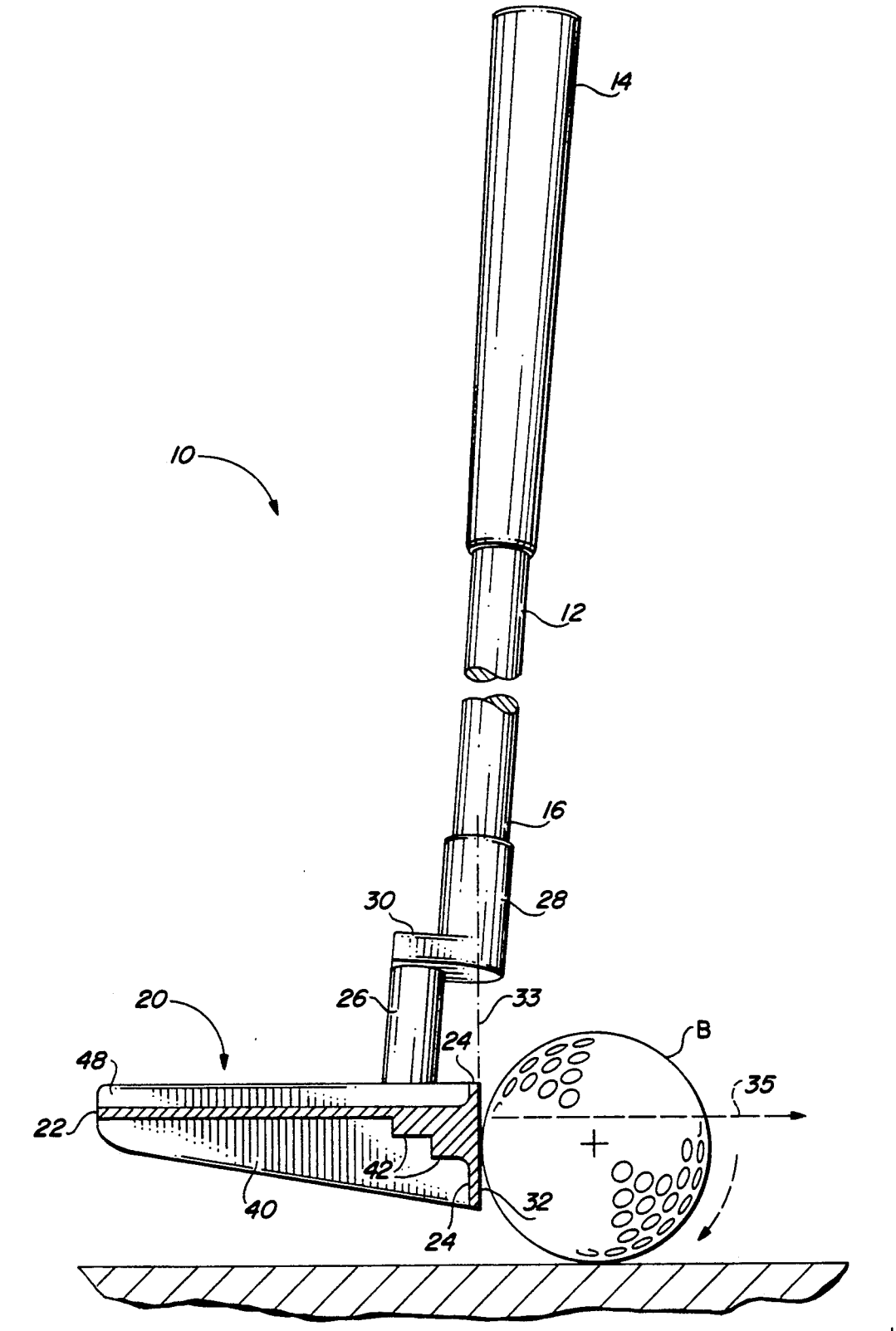
FIG. 7 is a side view of the putter shown in FIGS. 1–7, and in which the club shaft is broken away, and a portion of the club head is shown in cross section.

The club head 20 further includes two additional lateral struts 38, 40 which extend rearwardly from the face plate 24 and generally normal to the plane of the club face, and with stepped weights 42 positioned between the struts 38, 40 (note FIGS. 4 and 7).

Referring again to FIGS. 1, 3 and 5, the club head 20 includes three risers 44, 46 and 48 extending upwardly from the body plate 22 generally parallel with the direction of desired ball travel and normal to the club face. Each of the risers 44, 46 and 48 include a respective alignment mark 45, 47 and 49. The middle alignment mark 47 is located along the center line of the club head 20, and generally represents the point at which the center of the ball should be struck. The other two inside alignment marks 45, 49 have a dimension between them that is equal to the diameter of a golf ball, as is shown by dimension GB in FIG. 8. The body plate 22 further includes a pair of grooves 50 each on opposite sides of the middle riser 46, which grooves receives an alignment guide 52, described in greater detail below with reference to FIGS. 11–13.

Figure 5:
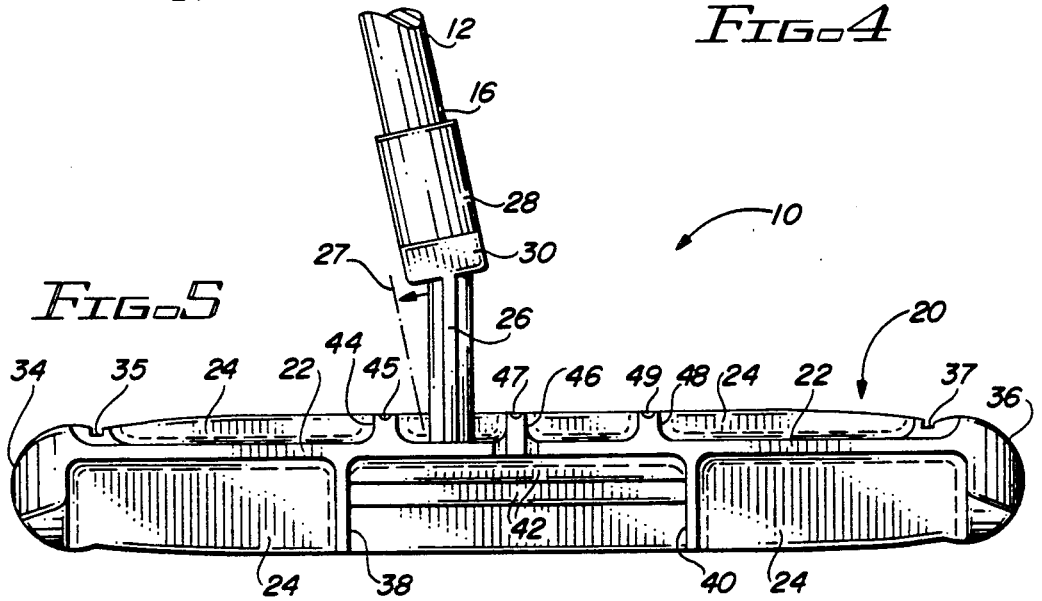
Figure 6:
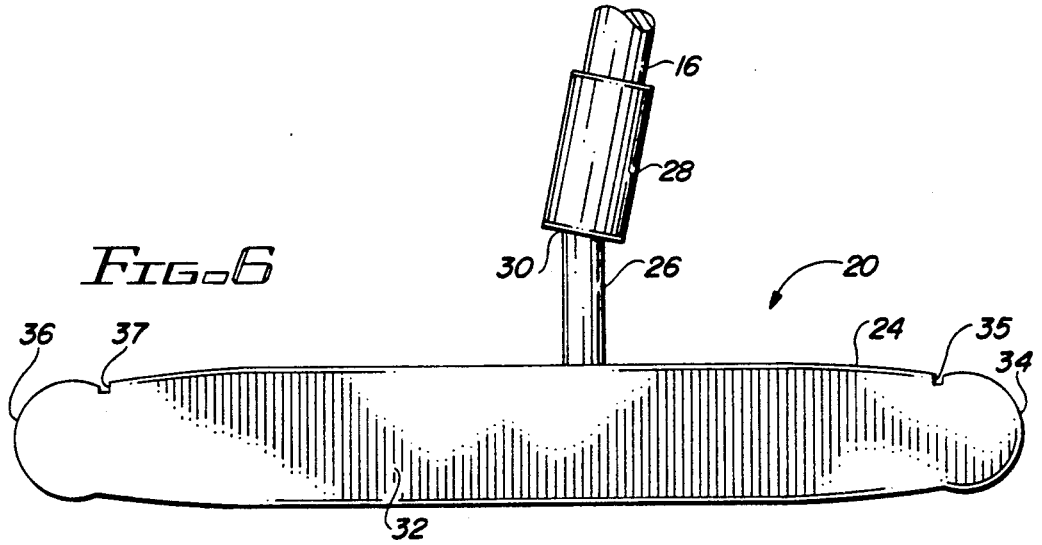

As is illustrated in FIG. 5, the upright 26 is positioned a distance away from the center of the club head 20, so as to avoid any interference with the attachment guide 52. Further, the oval cross-section of the upright 26 is such that the long axis of the oval extends generally lateral to the club face and parallel with the riser 46. The oval cross-sectional configuration permits the upright to be slightly bent in one direction or the other as required by the particular needs of a golfer, as is shown by the arrow and dotted line at reference numeral 27 in FIG. 5.

As will also be understood by the dotted lines 33 in FIG. 7, the forwardly extending offset 30 permits the distal end 16 of the club shaft 12 to be attached in the fitting 28 generally in or forward of the plane of the club face 32, thus assisting in imparting the desired top spin.

Top spin is achieved with the putter 10 in a facile manner, as is shown in FIG. 7. There, it is easily seen that the principal weight of the club head 20 is contained in the body plate 22 and the weights 42, thus imparting energy to the ball at a level indicated by the horizontal dotted line 35 (FIG. 7), which is above the center of gravity of the ball B thereby imparting the desired top spin.

Figure 9:
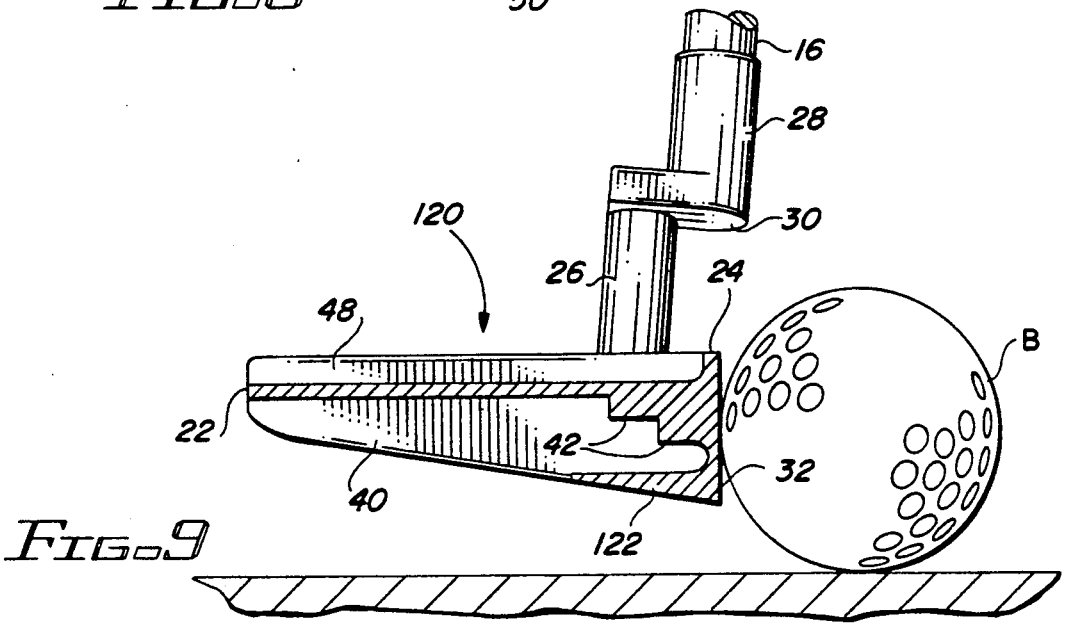
FIG. 9 is a side view like that of FIG. 7, illustrating an alternate form of the club head of the present invention.
Figure 10:
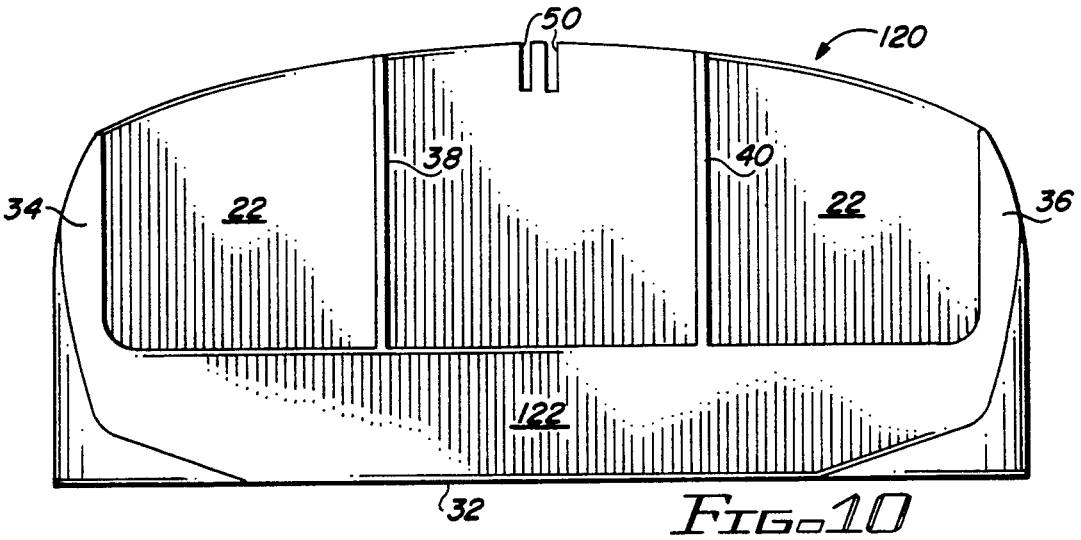
FIG. 10 is a bottom view of the alternate form of the club head shown in FIG. 9.

An alternate form of the putter head is shown in FIGS. 9 and 10, and referred to generally by the reference numeral 120.

The club head 120 includes all of the same features of the club head 20 of FIGS. 1–8, and which are referred to by the same reference numerals (e.g., body plate 22 and face plate 24). However, the club head 120 further includes a bottom plate 122 which extends rearwardly from the bottom of the face plate 24 and generally parallel with the body plate 22. The bottom plate 122 is desirable for use on putting greens where the grass is not closely cropped, and where a face plate of the type shown in FIG. 7 is likely to be caught by taller grass on the putting green.

Figure 11:
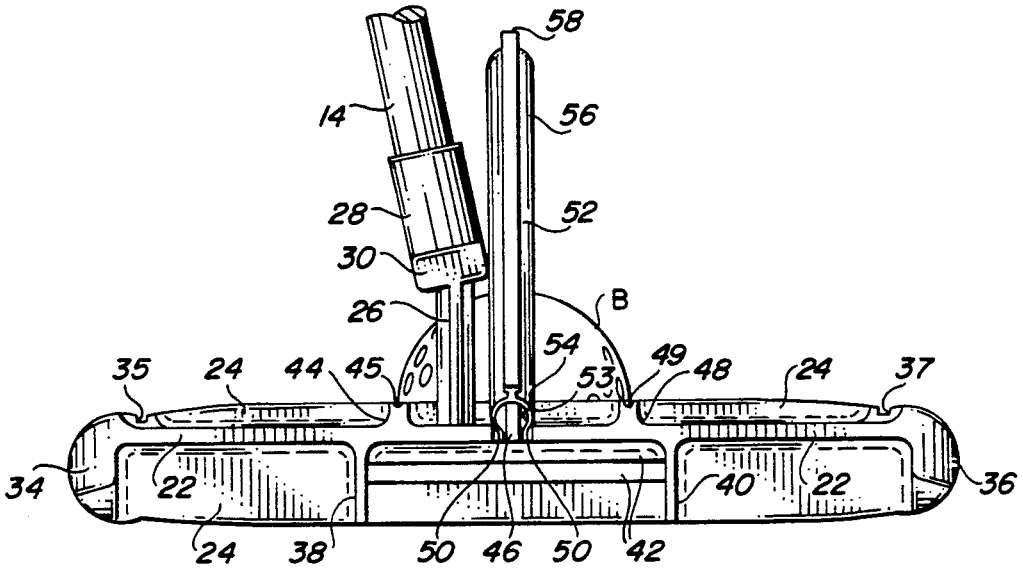
FIGS. 11, 12 and 13 are rear, side and top views, respectively, illustrating the use of an alignment guide in accordance with the present invention.
Figure 12:
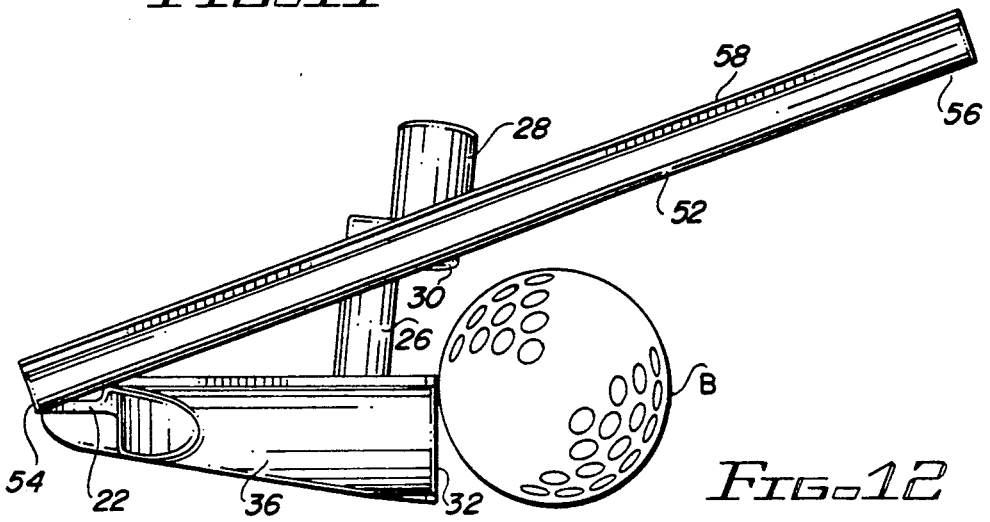
Figure 13:
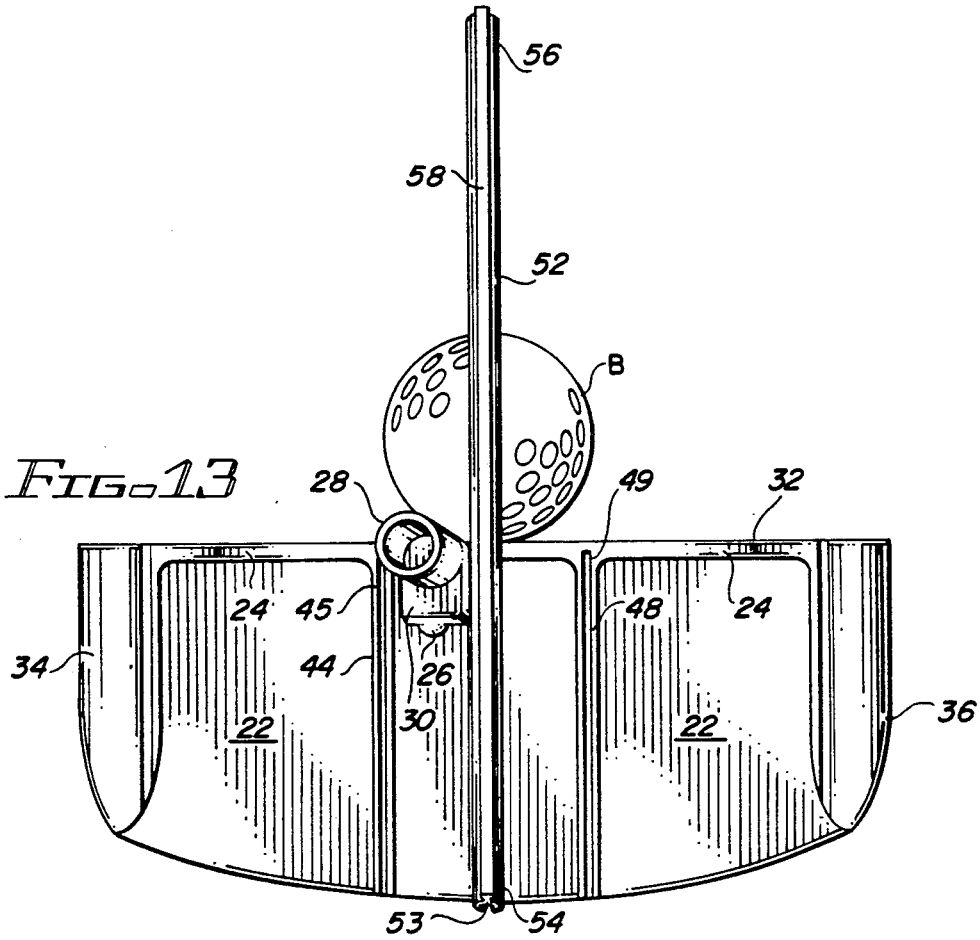
Figure 15:
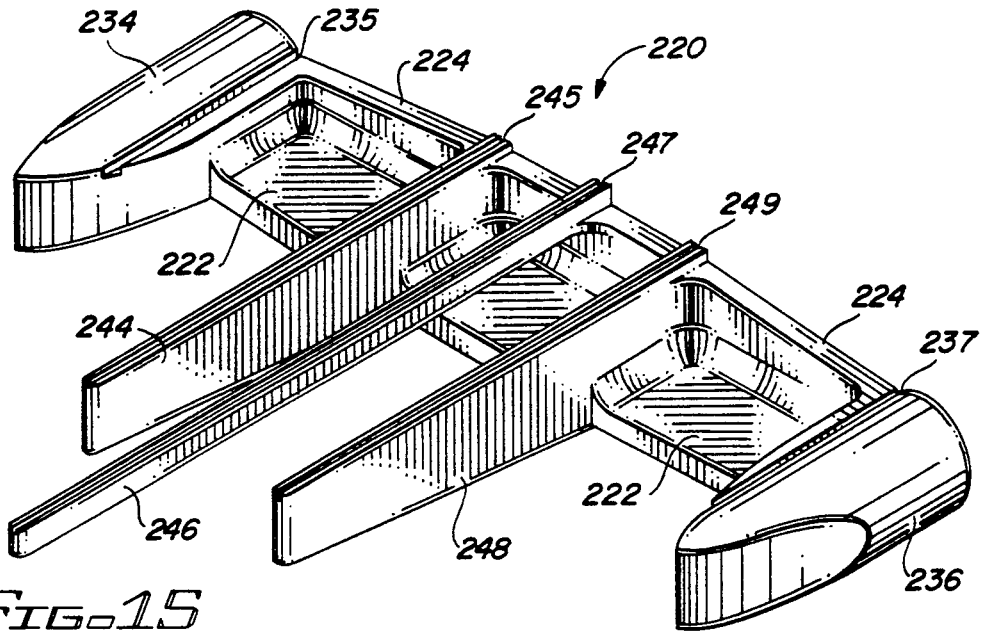
FIG. 15 is a perspective view illustrating another form of a head for a putter in accordance with the present invention.
Figure 16:
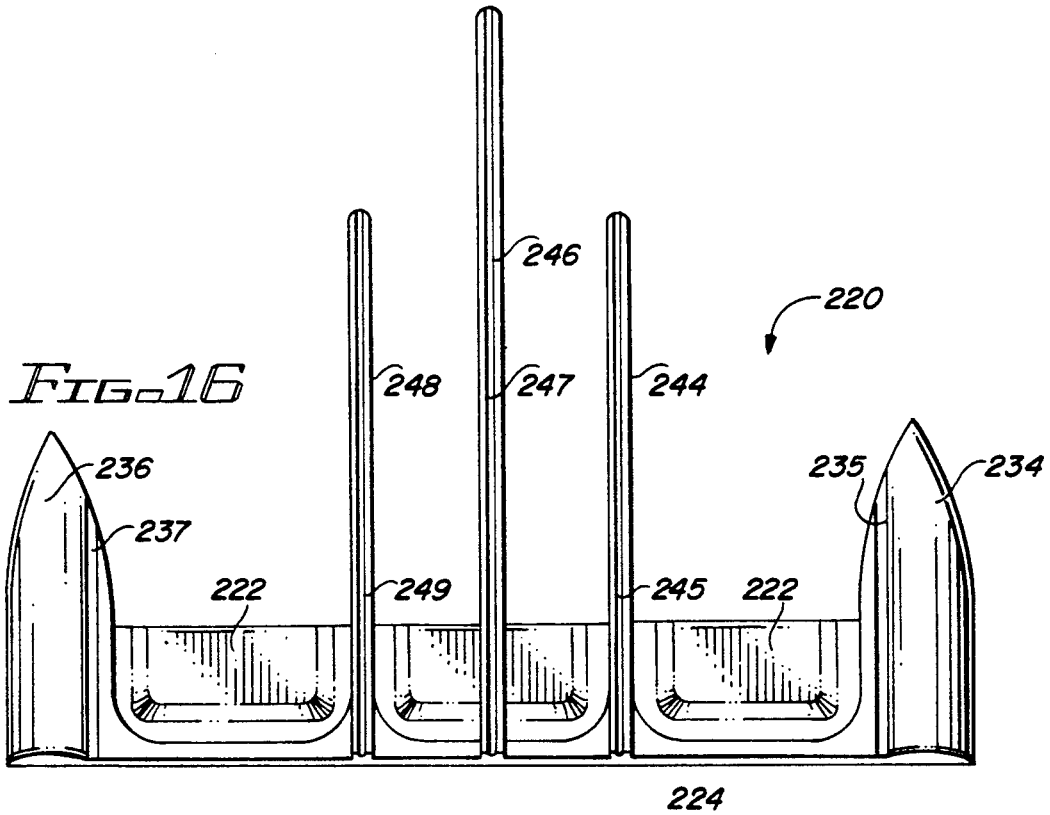
FIGS. 16–20 are top, front, bottom, rear and side views, respectively, of the alternate form of the putter head shown in FIG. 15.
Figure 17:
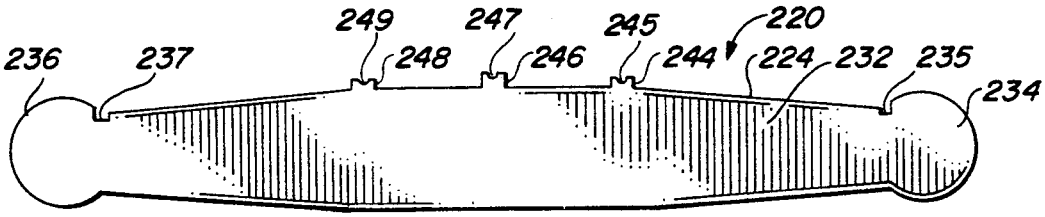
Figure 18:
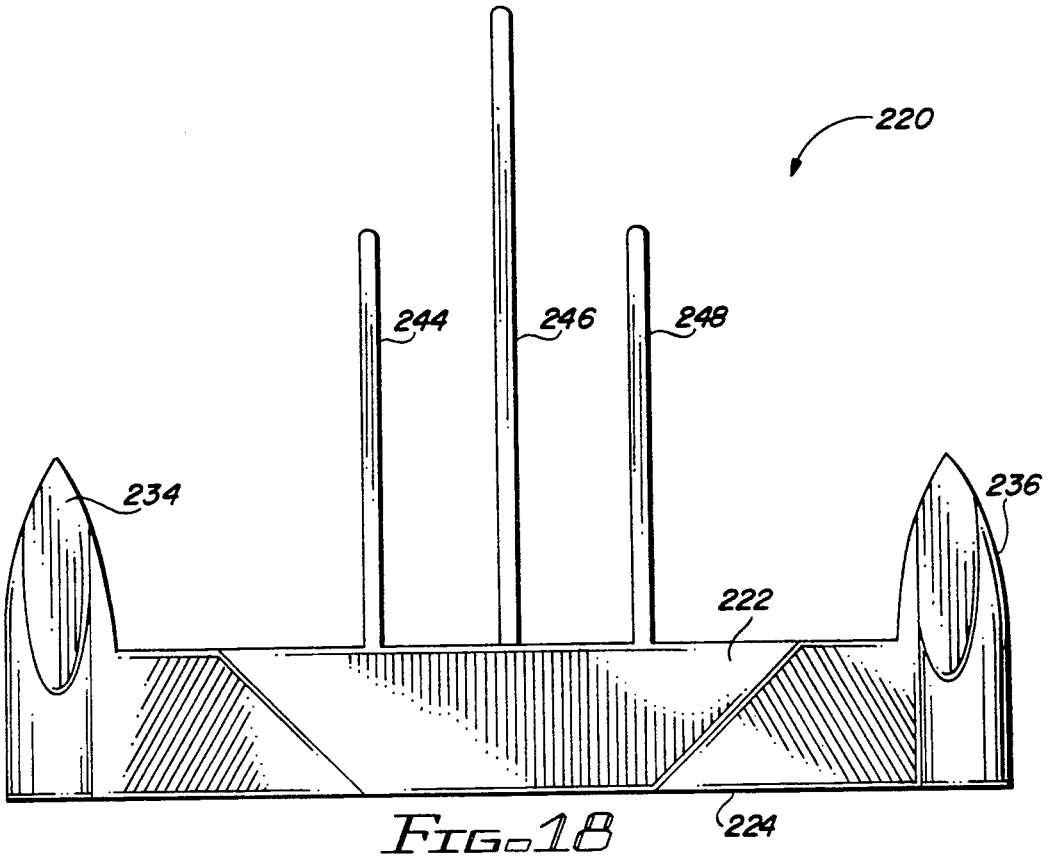
Figure 19:
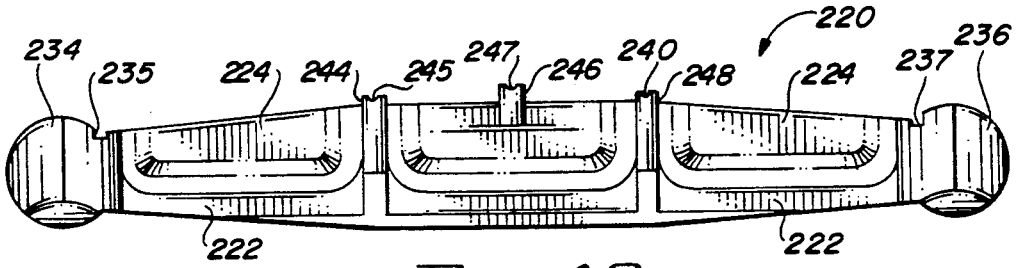
Figure 20:
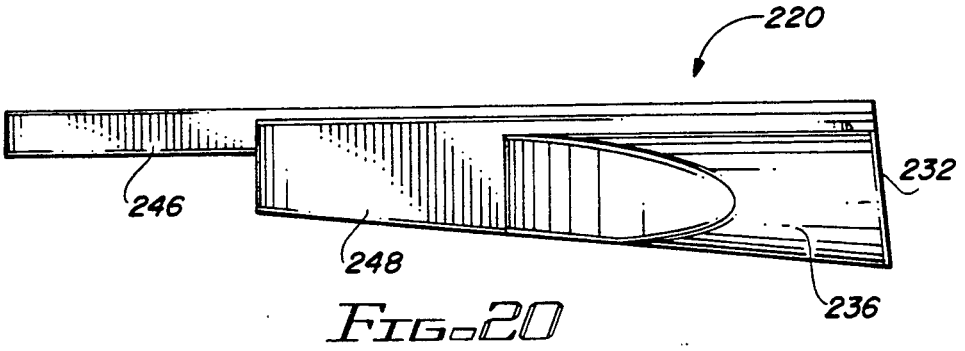

FIGS. 11-13 illustrate the use of the alignment guide 52 with the putter 10 of FIGS. 1-8. In FIGS. 11-13, the alignment guide 52 includes a rearward end 54, forward end 56 and a sighting element 58 extending along its longitudinal dimension. The alignment guide 52 is preferably fabricated of a tubular flexible material having a longitudinal slit 53 for fitting onto the riser 46 at the rearward end 54. As is shown in FIGS. 12 and 13, the alignment guide has a sufficient dimension to extend from the rear of the body plate 22, across the plane of the club face 32 and over a golf ball B adjacent the club face. It will of course be understood that once the alignment guide 52 is used to train the golfer in the proper alignment of the club face 32 relative to the ball and the hole to which the ball is being directed, the alignment guide may be easily removed by simply pulling it away from the riser 46 at the rearward end 54.

Figure 14:
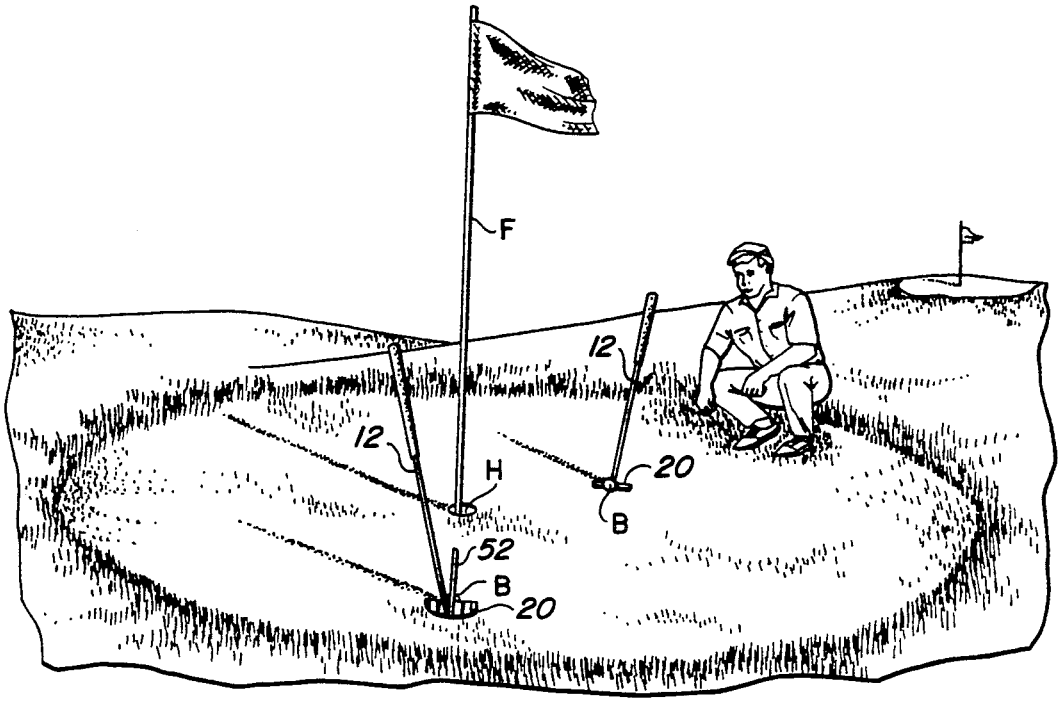
FIG. 14 is a pictorial illustration of the manner in which a golfer utilizes the putter of the present invention.

The manner of use of the putter 10 of the present invention is pictorially illustrated in FIG. 14. As can be seen, the ability of the putter to stand upright while unattended permits a golfer to utilize the alignment guide 52 and/or the alignment marks to properly position the plane of the club face relative to the ball B and the hole H, either by viewing the situation from behind the club, or from behind the flag F. In this way, a golfer's putting skills can be significantly improved, utilizing a putter having training features in which putter may also be used in a regular golf game.

Another form of the club head is shown and described with reference to FIGS. 15-20.

The club head 220 of FIGS. 15-20 includes a body plate 222 attached to the club shaft (not shown) and a face plate 224 having a ball-striking forward face 232. The club head 220 includes weighted struts 234, 236 at the outer side extremities of the body plate 222, with respective alignment marks 235 and 237 which have a dimension between those alignment marks equal to the dimension of the ball drop zone, as illustrated in FIG. 8.

Likewise, risers/struts 244, 246 and 248 extend generally parallel with the direction of desired ball travel and lateral to the ball striking face 232, and each of which have respective alignment marks 245, 247 and 249. Alignment mark 247 is centrally positioned and indicates the desired point at which the center line of the golf ball should be struck, and the dimension between the other two inside alignment marks 245, 249 is equal to the diameter of a golf ball. It is of course understood that the alignment guide 52 (FIGS. 11-13) may be fitted on the riser 246 for tracing purposes.

The form of construction of the putter heads 20, 120 and 220 provides a facile means for manufacturing putters having a variety of different characteristics. For example, as shown in FIG. 3, the nozzle, consisting of upright 26, offset 30 and fitting 28 may be located along the dotted line 51 during the manufacturing process.

This concludes the description of the preferred embodiments. A reading by those skilled in the art will bring to mind various changes without departing from the spirit and scope of the invention. It is intended, however, that the invention only be limited by the following appended claims.

What is claimed is:

1. A putter useful for training a golfer and improving putting skills, comprising:

a club shaft having a proximal gripping end adapted to be held by the golfer, and a distal end;

a club head having a body plate with an upper surface fixed to the club shaft at the distal end, the club head having a sufficient dimension lateral to the direction of the club shaft and the head and the shaft being balanced so as to permit the head to lie upon a playing surface such that a player may leave the club with its shaft standing upright while unattended, the club head having a forward face for striking a golf ball;

an elongated alignment guide having a sufficient dimension to extend from the upper surface of the club head, across the plane of the club face and over a golf ball adjacent the club face; and means for releasably attaching one end of the alignment guide to the upper surface of the club head so as to permit the guide to extend vertically above club face and over the ball.

2. The putter recited in claim 1 wherein the axis of the club shaft intersects the upper surface of the club head, and wherein the alignment guide lies in a plane extending generally through the point of intersection of the axis of the club shaft with the upper surface, so that the alignment guide is extending golf ball relative to the optimal point on the club face for striking the golf ball.

3. The putter recited in claim 2 further comprising means for attaching the club shaft to the upper surface of the club head at a point offset from the point of intersection of the club axis, so that while the axis of the club shaft passes generally through the plane of the alignment guide, the club shaft offset prevents the shaft from interfering with the use of the alignment guide.

4. The putter recited in claim 1 wherein the alignment guide attaching means comprises a ridge extending upwardly from the upper surface of the club head and wherein the elongated alignment guide comprises a flexible material including an opening for fitting onto the ridge.

5. The putter recited in claim 4 wherein the upper surface of the club head includes two grooves, each groove alongside the ridge and dimensioned to receive a portion of the alignment guide, the grooves angled to facilitate the extension of the alignment guide upwardly from the upward surface and the club face, and across the top of a golf ball lying adjacent the face.

6. The putter recited in claim 1 wherein an extension of the axis of the club shaft intersects the body plate, and wherein the alignment guide attaching means includes a place on the body plate which extends generally through the point of intersection of the extension of the axis of the club shaft, so that when the alignment guide is extending over a golf ball, the ball is generally in alignment with the axis of the club shaft relative to the optimum direction of ball travel to the hole.

7. The putter recited in claim 6 further comprising means for attaching the club shaft to the body plate at a point offset from the alignment guide attaching means, so that while the extension of the axis of the club shaft passes generally through the plane of the alignment guide attaching means, the club shaft offset prevents the shaft from interfering with the use of the alignment guide.

8. The putter recited in claim 1 wherein the alignment guide attaching means comprises a ridge extending upwardly from the body plate, and wherein the elongated alignment guide comprises a flexible material and includes an opening for fitting onto the ridge.

9. The putter recited in claim 8 wherein the body plate further comprises a pair of grooves, each groove alongside the ridge and dimensioned to receive a portion of the alignment guide, the grooves angled to facilitate the extension of the alignment guide upwardly from the club face and a golf ball adjacent the face.

10. A method for training a golfer to improve gold skills, comprising the steps of:

providing a golf club having a shaft with a proximal gripping adapted to be held by the golfer and the shaft having a distal end, the golf club including a club head fixed to the distal end of the club shaft and having a forward face for striking a golf ball;

dimensioning and balancing means with the club head so as to permit the club to lie upon a playing surface such that a player may leave the club with its shaft standing upright while unattended;

providing an alignment guide having a sufficient elongated dimension so as to extend across the club head, across the plane of the club face and over the top of an adjacent golf ball; and attaching the elongated alignment guide to the club head to extend in a direction substantially normal to the club face and over the golf ball, and using the alignment guide to determine the optimum position of the club face relative to the direction of ball travel.

11. The method recited in claim 10 further comprising the step of placing a first pair of spaced alignment marks across an upper surface of the club head and normal to the club face, the space between the alignment marks equal to the diameter of a golf ball.

12. The method recited in claim 11 further comprising the step of disposing the first pair of alignment marks on opposite sides of the plane of the axis guide.

13. The method recited in claim 11 further comprising the step of providing a second pair of alignment marks along the club head and normal to the club face, the second pair of alignment marks spaced apart a dimension equal to the ball drop zone.

* * * * *